US008404413B2

(12) United States Patent
Yu et al.

(10) Patent No.: US 8,404,413 B2
(45) Date of Patent: Mar. 26, 2013

(54) FLEXIBLE IMAGING MEMBERS HAVING STRESS-FREE IMAGING LAYER(S)

(75) Inventors: Robert C. U. Yu, Webster, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 369 days.

(21) Appl. No.: 12/782,671

(22) Filed: May 18, 2010

(65) Prior Publication Data

US 2011/0287352 A1 Nov. 24, 2011

(51) Int. Cl.
*G03G 5/047* (2006.01)

(52) U.S. Cl. ..... 430/58.8; 430/56; 430/58.4

(58) Field of Classification Search ..... 430/56–58.4
See application file for complete search history.

(56) References Cited

U.S. PATENT DOCUMENTS

| | | | | |
|---|---|---|---|---|
| 3,121,006 | A | 2/1964 | Middleton et al. | |
| 3,820,989 | A | 6/1974 | Rule et al. | |
| 3,837,851 | A | 9/1974 | Shattuck et al. | |
| 3,895,944 | A | 7/1975 | Wiedemann et al. | |
| 4,150,987 | A | 4/1979 | Anderson et al. | |
| 4,245,021 | A | 1/1981 | Kazami et al. | |
| 4,256,821 | A | 3/1981 | Enomoto et al. | |
| 4,265,990 | A | 5/1981 | Stolka et al. | |
| 4,278,746 | A | 7/1981 | Goto et al. | |
| 4,286,033 | A | 8/1981 | Neyhart et al. | |
| 4,297,426 | A | 10/1981 | Sakai et al. | |
| 4,315,982 | A | 2/1982 | Ishikawa et al. | |
| 4,338,387 | A | 7/1982 | Hewitt | |
| 4,338,388 | A | 7/1982 | Sakai et al. | |
| 4,385,106 | A | 5/1983 | Sakai | |
| 4,387,147 | A | 6/1983 | Sakai | |
| 4,399,207 | A | 8/1983 | Sakai et al. | |
| 4,399,208 | A | 8/1983 | Takasu et al. | |
| 4,587,189 | A | 5/1986 | Hor et al. | |
| 4,664,995 | A | 5/1987 | Horgan et al. | |
| 4,906,545 | A * | 3/1990 | Fukagai et al. | 430/58.05 |
| 4,988,597 | A | 1/1991 | Spiewak et al. | |
| 5,215,839 | A | 6/1993 | Yu | |
| 5,244,762 | A | 9/1993 | Spiewak et al. | |
| 5,660,961 | A | 8/1997 | Yu | |
| 5,677,094 | A * | 10/1997 | Umeda et al. | 430/58.05 |
| 5,697,024 | A | 12/1997 | Mishra | |
| 5,703,487 | A | 12/1997 | Mishra | |
| 5,756,245 | A | 5/1998 | Esteghamatian et al. | |
| 5,958,638 | A | 9/1999 | Katayama et al. | |
| 6,008,653 | A | 12/1999 | Popovic et al. | |
| 6,119,536 | A | 9/2000 | Popovic et al. | |
| 6,150,824 | A | 11/2000 | Mishra et al. | |
| 6,214,514 | B1 | 4/2001 | Evans et al. | |
| 6,660,441 | B2 | 12/2003 | Yu | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,361,440 | B2 | 4/2008 | Mishra et al. | |
| 7,413,835 | B2 | 8/2008 | Lin et al. | |
| 7,422,831 | B2 | 9/2008 | Yu | |
| 7,592,111 | B2 | 9/2009 | Yu et al. | |
| 7,611,811 | B2 | 11/2009 | Yu et al. | |
| 2006/0275681 | A1 * | 12/2006 | Bellino et al. | 430/58.4 |
| 2008/0113285 | A1 * | 5/2008 | Nakamori et al. | 430/48 |

* cited by examiner

*Primary Examiner* — Mark F Huff
*Assistant Examiner* — Rashid Alam
(74) *Attorney, Agent, or Firm* — Pillsbury Winthrop Shaw Pittman LLP

(57) ABSTRACT

Present embodiments are directed to the preparation of curl-free flexible imaging members used in electrostatography. More particularly, the embodiments pertain to a structurally simplified flexible electrophotographic imaging member, including the incorporation of a plasticizer or a blend of plasticizers in the imaging layer(s) to effect imaging layer(s) stress relieving outcome for curl control without the need of an anticurl back coating, and methods for making and using the imaging member.

15 Claims, 2 Drawing Sheets

FLEXIBLE IMAGING MEMBERS HAVING STRESS-FREE IMAGING LAYER(S)

BACKGROUND

The presently disclosed embodiments are directed to flexible imaging members used in electrostatography. More particularly, the embodiments pertain a structurally simplified flexible electrophotographic imaging member having stress-free imaging layer(s) that comprise a plasticizer blend and methods for making and using the imaging member.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Flexible electrostatographic imaging members are well known in the art. Typical flexible electrostatographic imaging members include, for example: (1) electrophotographic imaging member belts (belt photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts; and seamed belts are usually formed by cutting a rectangular sheet from a web, overlapping opposite ends, and welding the overlapped ends together to form a welded seam. Typical electrophotographic imaging member belt comprises a charge transport layer, a charge generating layer, and optional layers on one side of a supporting substrate layer and does also include an anti back coating on the opposite side of the substrate to imaging member flatness. For typical electrographic imaging member belt, it does, however, have a more simple material structure; it includes a dielectric imaging layer on one side of a supporting substrate and an anti-curl back coating on the opposite side of the substrate to render flatness. Although the scope of the present embodiments covers the preparation of all types of flexible electrostatographic imaging members which have simplified structure and curl-free requiring no anti curl back coating, however for reason of simplicity, the discussion hereinafter will focus and be represented only on flexible electrophotographic imaging members.

One type of flexible composite photoconductive layer used in xerography is illustrated in U.S. Pat. No. 4,265,990 which describes a photosensitive imaging member having at least two electrically operative layers. One layer comprises a photoconductive layer which is capable of photogenerating holes and injecting the photogenerated holes into a contiguous charge transport layer. Generally, the two electrically operative layers are supported on a conductive layer support substrate, with the photoconductive layer being sandwiched between a contiguous charge transport layer and the supporting conductive layer. In this negatively charged imaging member, the charge transport layer is therefore the top outermost exposed layer. In the alternative imaging member design, the charge transport layer is, however, sandwiched between the supporting electrode and a photoconductive layer. Since the typical flexible electrophotographic imaging members exhibit undesirable upward imaging member curling-up after completion of the electrically operative layers, the application of an anticurl back coating onto the backside of the support substrate is necessary to provide the appropriate imaging members with desirable flatness.

The flexible photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the top outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members should be highly flexible, adhere well to adjacent layers, and exhibit predictable electrical characteristics within narrow operating limits to provide excellent toner images over many thousands of cycles. One type of multilayered flexible photoreceptor that has been employed as a belt in electrophotographic imaging systems comprises a substrate, a conductive layer, an optional blocking layer, an optional adhesive layer, a charge generating layer, a charge transport layer and a conductive ground strip layer adjacent to one edge of the imaging layers, and may optionally include an overcoat layer over the imaging layer(s) to provide abrasion/wear protection. In such a photoreceptor, it does usually further comprise an anticurl back coating layer on the side of the substrate opposite the side carrying the conductive layer, support layer, blocking layer, adhesive layer, charge generating layer, charge transport layer, and other layers.

Typical negatively-charged electrophotographic imaging member belts, such as flexible photoreceptor belt designs, are made of multiple layers comprising a flexible supporting substrate, a conductive ground plane, a charge blocking layer, an optional adhesive layer, a charge generating layer, a outermost charge transport layer. In this imaging member configuration, the charge transport layer is the outermost exposed top layer to be coated by solution application, then followed by drying the wet coating layer at elevated temperatures of about 120° C., and finally cooling it down to ambient room temperature of about 25° C. When a production web stock of several thousand feet of coated multilayered photoreceptor material is obtained after finishing solution application of the charge transport layer coating and through drying/cooling process, upward curling of the multilayered photoreceptor is observed. This upward curling is a consequence of thermal contraction mismatch between the charge transport layer and the substrate support. Since the typical charge transport layer (consisting of 50% wt polycarbonate binder and 50% wt charge transport compound) in a conventional electrophotographic imaging member device has a coefficient of thermal contraction approximately 3.7 times greater than that of the flexible substrate support, the charge transport layer does therefore have a larger dimensional shrinkage than that of the substrate support as the imaging member web stock cools down to ambient room temperature. The exhibition of imaging member curling after completion of charge transport layer coating is due to the consequence of the heating/cooling processing step, according to the mechanism: (1) as the web stock carrying the wet applied charge transport layer is dried at elevated temperature, dimensional contraction does occur when the wet charge transport layer coating is losing its solvent during 120° C. elevated temperature drying, but at 120° C. the charge transport layer remains as a viscous flowing liquid after losing its solvent. Since its glass transition temperature (Tg) is at 85° C., the charge transport layer after losing of solvent will flow to re-adjust itself, release internal stress, and maintain its dimension stability; (2) as the charge transport layer now in the viscous liquid state is cooling down further and reaching its glass transition temperature (Tg) at 85° C., the CTL instantaneously solidifies and adheres to the charge generating layer because it has then transformed itself from being a viscous liquid into a solid layer at its Tg; and (3) eventual cooling down the solid charge transport layer of the imaging member web from 85° C. down to 25° C. room ambient will then cause the charge transport layer to contract more than the substrate support since it has about 3.7 times greater thermal coefficient of dimensional contraction than that of the substrate support. This differential in dimensional contraction results in tension strain built-up in the charge transport layer which therefore, at this instant, pulls the imaging member upward to exhibit curling. If unrestrained at this point, the imaging member web stock will spontaneously curl upwardly into a 1.5-inch tube. To offset the curling, an anticurl back coating is applied to the backside of the flexible substrate support, opposite to the side having the charge transport layer, and render the imaging member web stock with desired flatness.

The upward curling of an electrophotographic imaging member web is undesirable because it hinders fabrication of the web into cut sheets and subsequent welding into a belt. An anticurl back coating, having an equal counter curling effect but in the opposite direction to the applied imaging layer(s), is applied to the reverse side of substrate support of the active imaging member to balance the curl caused by the mismatch of the thermal contraction coefficient between the substrate and the charge transport layer, resulting in greater charge transport layer dimensional shrinkage than that of the substrate. Although the application of an anticurl back coating is effective to counter and remove the curl, nonetheless the resulting imaging member in flat configuration does tension the charge transport layer creating an internal build-in strain of about 0.27% in the layer. The magnitude of charge transport layer internal build-in strain is very undesirable, because it is additive to the induced bending strain of an imaging member belt as the belt bends and flexes over each belt support roller during dynamic fatigue belt cyclic motion under a normal machine electrophotographic imaging function condition in the field. The summation of the internal strain and the cumulative fatigue bending strain sustained in the charge transport layer has been found to exacerbate the early onset of charge transport layer cracking, preventing the belt to reach its targeted functional imaging life. Moreover, imaging member belt employing an anticurl backing coating has additional total belt thickness to thereby increase charge transport layer bending strain and speed up belt cycling fatigue charge transport layer cracking. The cracks formed in the charge transport layer as a result of dynamic belt fatiguing are found to manifest themselves into copy print-out defects, which thereby adversely affect the image quality on the receiving paper.

Various belt function deficiencies have also been observed in the common anticurl back coating formulations used in a typical conventional imaging member belt, such as the anticurl back coating does not always providing satisfying dynamic imaging member belt performance result under a normal machine functioning condition; for example, exhibition of anticurl back coating wear and its propensity to cause electrostatic charging-up are the frequently seen problems to prematurely cut short the service life of a belt and requires its frequent costly replacement in the field. Anticurl back coating wear under the normal imaging member belt machine operational conditions reduces the anticurl back coating thickness, causing the lost of its ability to fully counteract the curl as reflected in exhibition of gradual imaging member belt curling up in the field. The Upward curling is undesirable during imaging belt function because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anticurl back coating wear, it does also cause the relatively rapid wearing away of the anti-curl produce debris which scatters and deposits on critical machine components such as lenses, corona charging devices and the like, thereby adversely affecting machine performance. Moreover, anticurl back coating abrasion/scratch damage does also produce unbalance forces generation between the charge transport layer and the anticurl back coating to cause micro belt ripples formation during electrophotographic imaging processes, resulting in streak line print defects in output copies to deleteriously impact image printout quality and shorten the imaging member belt functional life.

Undesirably, high contact friction of the anticurl back coating against machine subsystems is further seen to cause the development of electrostatic charge built-up problem. In other machines the electrostatic charge builds up due to contact friction between the anti-curl layer and the backer bars increases the friction and thus requires higher torque to pull the belts. In full color machines with 10 pitches this can be extremely high due to large number of backer bars used. At times, one has to use two drive rollers rather than one which are to be coordinated electronically precisely to keep any possibility of sagging. Static charge built-up in anticurl back coating increases belt drive torque, in some instances, has also been found to result in absolute belt stalling. In other cases, the electrostatic charge build up can be so high as to cause sparking.

Another problem encountered in the conventional belt photoreceptors using a bisphenol A polycarbonate anticurl back coating that are extensively cycled in precision electrostatographic imaging machines utilizing belt supporting backer bars, is an audible squeaky sound generated due to high contact friction interaction between the anticurl back coating and the backer bars. Further, cumulative deposition of anticurl back coating wear debris onto the backer bars may give rise to undesirable defect print marks formed on copies because each debris deposit become a surface protrusion point on the backer bar and locally forces the imaging member belt upwardly to interferes with the toner image development process. On other occasions, the anticurl back coating wear debris accumulation on the backer bars does gradually increase the dynamic contact friction between these two interacting surfaces of anticurl back coating and backer bar, interfering with the duty cycle of the driving motor to a point where the motor eventually stalls and belt cycling prematurely ceases. Additionally, it is important to point out that electrophotographic imaging member belts prepared that required anticurl back coating to provide flatness have more than above list of problems, they do indeed incur additional material and labor cost impact to imaging members' production process.

Thus, electrophotographic imaging members comprising a supporting substrate, having a conductive surface on one side, coated over with at least one photoconductive layer (such as the outermost charge transport layer) and coated on the other side of the supporting substrate with a conventional anticurl back coating that does exhibit deficiencies which are undesirable in advanced automatic, cyclic electrophotographic imaging copiers, duplicators, and printers. While the above mentioned electrophotographic imaging members may be suitable or limited for their intended purposes, further improvement on these imaging members are required. For example, there continues to be the need for improvements in such systems, particularly for an imaging member belt that has sufficiently flatness, no charge transport layer ripple formation caused by anticurl back coating wear, nil or reduced wear debris generation, and eliminated the anticurl back coating associated electrostatic charge build-up problem even in larger printing apparatuses. With many of above mentioned shortcomings and problems associated with electrophotographic imaging members having an anticurl back coating now understood, therefore there is an urgent need to resolve these issues through the development of a new material formulation and methodology for fabricating imaging members that produce improve function and meet future machine imaging member belt life extension need. In the present disclosure, a charge transport layer material reformulation method and process of making a flexible imaging member free of the mentioned deficiencies have been identified and demonstrated through the preparation of anticurl back coating free imaging member that has reasonable flatness. The improved curl-free imaging member without the need of a conventional anticurl back coating suppresses abrasion/wear failure and extend the charge transport layer cracking will be described in detail in the following.

The present application is related to commonly assigned U.S. Pat. Nos. 7,361,440; 7,413,835; 7,422,831; and 7,611,811, which are all herein incorporated by reference.

Conventional photoreceptors are disclosed in the following patents, a number of which describe the presence of light scattering particles in the undercoat layers: U.S. Pat. Nos. 5,660,961; 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

U.S. Pat. No. 6,660,441 discloses an electrophotographic imaging member having a substrate support material which eliminates the need of an anticurl backing layer, a substrate support layer and a charge transport layer having a thermal contraction coefficient difference in the range of from about $-2\times10^{-5}$/° C. to about $+2\times10^{-5}$/° C., a substrate support material having a glass transition temperature (Tg) of at least 100° C., wherein the substrate support material is not susceptible to the attack from the charge transport layer coating solution solvent and wherein the substrate support material is represented by two specifically selected polyimides.

In U.S. Pat. No. 7,413,835, it discloses an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

U.S. Pat. No. 7,592,111, discloses an imaging member formulated with a liquid carbonate. The imaging electrostatographic member exhibits improved service life.

SUMMARY

According to aspects illustrated herein, there is provided a flexible imaging member comprising a flexible imaging member comprising: a flexible substrate, a charge generating layer disposed on the substrate, and at least one charge transport layer disposed on the charge generating layer, wherein the charge transport layer comprises a charge transport component molecularly dispersed in a polycarbonate binder and at least one plasticizer, the plasticizer being a dibasic alkyl ester liquid having the following formula $$R_1OOC(CH_2)_nCOOR_2$$

wherein n is an integer from 1 to 10; $R_1$ and $R_2$ are alky having from about 1 to about 4 carbons, such $CH_3$, $CH_3CH_2$, $CH_3CH_2CH_2$, $CH_3CH_2CH_2CH_2$; and $R_1$ is the same as $R_2$ or $R_1$ is the different from $R_2$, and further wherein the flexible imaging member does not include an anticurl back coating layer.

In further embodiments, there is provided a flexible imaging member comprising: a flexible substrate, a charge generating layer disposed on the substrate, and multiple charge transport layers disposed on the charge generating layer, wherein the multiple charge transport layers each comprise a charge transport component molecularly dispersed in a polycarbonate binder and at least one plasticizer, the plasticizer being a dibasic alkyl ester liquid having the following formula $$R_1OOC(CH_2)_nCOOR_2$$

wherein n is an integer from 1 to 10; $R_1$ and $R_2$ are alky having from about 1 to about 4 carbons, such $CH_3$, $CH_3CH_2$, $CH_3CH_2CH_2$, $CH_3CH_2CH_2CH_2$; and $R_1$ is the same as $R_2$ or $R_1$ is the different from $R_2$, and further wherein the flexible imaging member does not include an anticurl back coating layer.

In yet further embodiments, there is provided a flexible imaging member comprising: a flexible substrate, a single imaging layer disposed on the substrate, wherein the single imaging layer has both charge generating and charge transporting capabilities and comprises a charge transport component molecularly dispersed in a polycarbonate binder and at least one plasticizer, the plasticizer being a dibasic alkyl ester liquid having the following formula $$R_1OOC(CH_2)_nCOOR_2$$

wherein n is an integer from 1 to 10; $R_1$ and $R_2$ are alky having from about 1 to about 4 carbons, such $CH_3$, $CH_3CH_2$, $CH_3CH_2CH_2$, $CH_3CH_2CH_2CH_2$; and $R_1$ is the same as $R_2$ or $R_1$ is the different from $R_2$, and further wherein the flexible imaging member does not include an anticurl back coating layer.

BRIEF DESCRIPTION OF THE DRAWINGS

For a better understanding of the details of present disclosure, reference may be had to the accompanying figures.

DETAILED DESCRIPTION

Figure 1:
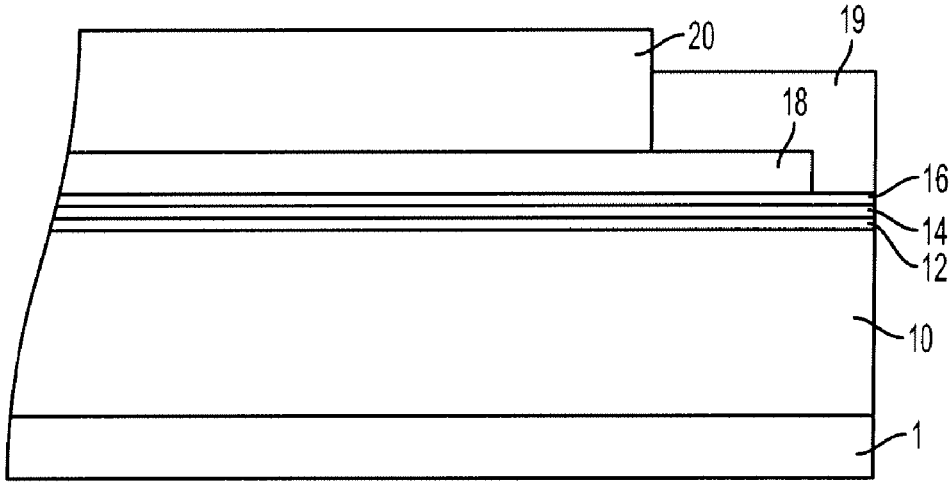
FIG. 1 is a cross-sectional view of a conventional flexible multilayered electrophotographic imaging member.

In the following description, reference is made to the accompanying drawings, which form a part hereof and which illustrate several embodiments. It is understood that other embodiments may be utilized and structural and operational changes may be made without departure from the scope of the present embodiments.

According to aspects illustrated herein, there is provided a flexible imaging member comprising a flexible substrate, a charge generating layer disposed on the substrate, and at least one charge transport layer disposed on the charge generating layer, wherein the charge transport layer comprises a polycarbonate, a charge transport compound of N,N'-diphenyl-N,N'-bis(3-methylphenyl)-1,1-biphenyl-4,4'-diamine, and a plasticizing liquid compound having a high boiling point, and further wherein the plasticizing liquid compound is miscible with both the polycarbonate and N,N'-diphenyl-N,N'-bis(3-methylphenyl)-1,1-biphenyl-4,4'-diamine. The imaging member thus prepared has reasonable flatness with the application of an anticurl back coating In another embodiment, there is provided a flexible imaging member comprising a flexible substrate, a charge generating layer disposed on the substrate, and at least one charge transport layer disposed on the charge generating layer, wherein the charge transport layer comprises a polycarbonate, a charge transport compound of N,N'-diphenyl-N,N'-bis(3-methylphenyl)-1,1-biphenyl-4,4'-diamine, and a blend of plasticizing liquid compounds having high boiling points, and further wherein the blend of plasticizing liquid compounds is miscible with both the polycarbonate and N,N'-diphenyl-N,N'-bis(3-methylphenyl)-1,1-biphenyl-4,4'-diamine, and further wherein the prepared imaging member has reasonable flatness without the application of an anticurl back coating.

In a further embodiment, there is provided a flexible imaging member comprising a flexible substrate, and a single imaging layer disposed on the substrate, wherein the single imaging layer disposed on the substrate has both charge generating and charge transporting capability and further wherein the single imaging layer comprises a polycarbonate, N,N'-diphenyl-N,N'-bis(3-methylphenyl)-1,1-biphenyl-4,4'-diamine, a charge generating pigment, and a plasticizing liquid compound having a high boiling point and being miscible with both the polycarbonate and N,N'-diphenyl-N,N'-bis(3-methylphenyl)-1,1-biphenyl-4,4'-diamine to give the resulting imaging member with reasonable flatness with out the application of an anticurl back coating.

In yet a further embodiment, there is provided a flexible imaging member comprising a flexible substrate, and a single imaging layer disposed on the substrate, wherein the single imaging layer disposed on the substrate has both charge generating and charge transporting capability and further wherein the single imaging layer comprises a polycarbonate, N,N'-diphenyl-N,N'-bis(3-methylphenyl)-1,1-biphenyl-4,4'-diamine, a charge generating pigment, and a mixture of plasticizing liquid compounds having high boiling point and being miscible with both the polycarbonate and N,N'-diphenyl-N,N'-bis(3-methylphenyl)-1,1-biphenyl-4,4'-diamine to render imaging member reasonable flatness with out the application of an anticurl back coating.

According to aspects illustrated herein, a curl free flexible imaging member is prepared to comprise of a flexible substrate, a conductive ground plane, a hole blocking layer, a charge generation layer, and an outermost charge transport layer without the need of an anti-curl back coating layer disposed onto the substrate on the side opposite of the charge transport layer; wherein, the charge transport layer is formulated to have nil or minima internal build-in stress/strain by the incorporation of a suitable liquid plasticizer or a mixture of plasticizers. To achieve the intended charge transport layer plasticizing result for effecting the elimination of an anticurl back coating, specific high boiler liquid candidates are chosen for the imaging member preparation charge transport layer incorporation. The specific high boiler liquid candidates are described below.

Single Plasticizing Liquid Incorporation

The dibasic alkyl ester (DBE) liquid chosen for charge transport layer(s) plasticizing use has a general molecular structure shown in Formula (I) below:

$$R_1OOC(CH_2)_nCOOR_2 \qquad \text{Formula (I)}$$

wherein n is an integer from 1 to 10; $R_1$ and $R_2$ are the same or different and are an alky having from about 1 to about 4 carbons, such as $CH_3$, $CH_3CH_2$, $CH_3CH_2CH_2$, $CH_3CH_2CH_2CH_2$.

In one specific embodiment, a substantially curl free flexible imaging member without anticurl back coating layer may be provided to comprise a flexible a substrate, a conductive ground plane, a hole blocking layer, a charge generation layer, and an outermost charge transport layer comprising a polycarbonate binder, charge transporting molecules, and a dimethyl adipate liquid plasticizer specifically selected from one of the dibasic alkyl esters derived from Formula (I). The molecular structure of dimethyl adipate liquid is shown in Formula (II) below:

$$CH_3OOC(CH_2)_4COOCH_3 \qquad \text{Formula (II)}$$

In another specific embodiment, a substantially curl free flexible imaging member without anticurl back coating layer may also be provided to comprise a flexible a substrate, a conductive ground plane, a hole blocking layer, a charge generation layer, and an outermost charge transport layer comprising a polycarbonate binder, charge transporting molecules, and a specific liquid dimethyl glutarate plasticizer selected from Formula (I). The liquid dimethyl glutarate plasticizer having a molecular structure is shown in Formula (III):

$$CH_3OOC(CH_2)_3COOCH_3 \quad \text{Formula (III)}$$

In yet another specific embodiment, a substantially curl free flexible imaging member without anticurl back coating layer may further be provided to comprise a flexible substrate, a conductive ground plane, a hole blocking layer, a charge generation layer, and an outermost charge transport layer comprising a polycarbonate binder, charge transporting molecules, and a specific liquid dimethyl succinate plasticizer selected from Formula (I). The liquid dimethyl succinate plasticizer having a molecular structure is shown in Formula (IV):

$$CH_3OOC(CH_2)_2COOCH_3 \quad \text{Formula (IV)}$$

Mixture of Plasticizing Liquid Incorporation

The dibasic alkyl ester liquid chosen for charge transport layer plasticizing effect is chosen to be a mixture of different structures through: (1) binary mixing of any two liquids selected from Formula (I) and (2) triple mixing of any three liquids selected from Formula (I). In the embodiments of this disclosure, the charge transport layer of the flexible imaging member is plasticized by mixing any two liquid components selected from the three di-methyl dibasic esters of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$. Since each of these three dimethyl dibasic esters is a viable plasticizer for charge transport layer incorporation, the binary plasticizers mixture can be prepared to have any desirable combination ratios.

In one specific embodiment, the charge transport layer of the flexible imaging member is formed according to the present disclosure by plasticizing it with three selected components of di-methyl dibasic esters-dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$. In embodiments, the mixing weight ratio of dimethyl adipate/dimethyl glutarate/dimethyl succinate is 19.2/58.4/22.4.

It is worth emphasizing that the selection of a specific alkyl dibasic ester liquid or a mixture of different combinations of the dibasic alkyl esters for imaging member charge transport layer plasticizing application is based on the facts that they are (a) high boiler liquids with boiling point exceeding 300° C. so their presence in the charge transport layer to effect plasticizing outcome will be permanent and (b) liquids totally miscible/compatible with both the charge transporting compound and the polymer binder such that their incorporation into the charge transport layer material matrix should cause no deleterious photoelectrical function of the resulting imaging member.

An exemplary embodiment of a conventional negatively charged flexible electrophotographic imaging member is illustrated in FIG. 1. The substrate 10 has an optional conductive layer 12. An optional hole blocking layer 14 disposed onto the conductive layer 12 is coated over with an optional adhesive layer 16. The charge generating layer 18 is located between the adhesive layer 16 and the charge transport layer 20. An optional ground strip layer 19 operatively connects the charge generating layer 18 and the charge transport layer 20 to the conductive ground plane 12, and an optional overcoat layer 32 is applied over the charge transport layer 20. An anti-curl backing layer 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An anticurl back coating layer 1 may then be formed on the backside of the support substrate 1. The anticurl back coating 1 is also solution coated, but is applied to the back side (the side opposite to all the other layers) of substrate 1, to render imaging member flatness.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$° C. to about $3\times10^{-5}$° C. and a Young's Modulus of between about $5\times10^{-5}$ psi ($3.5\times10^{-4}$ Kg/cm2) and about $7\times10^{-5}$ psi ($4.9\times10^{4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, MYLAR or PEN having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl) methyl diethoxysilane, which has the formula [H2N(CH2)3] CH33Si(OCH3)2, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a molecular weight of about 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport layer

The charge transport layer 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The charge transport layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the charge transport layer 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the charge transport layer can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis (alkylphenyl)-1,1-biphenyl-4,4-diamines, such as mTBD, which has the formula (N,N'-diphenyl-N,N'-bis[3-methylphenyl]-[1,1-biphenyl]-4,4'-diamine), N,N'-diphenyl-N, N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 20 may be, for example, at least about 5 weight % and may comprise up to about 60 weight %. The concentration or composition of the charge transport component may vary through layer 20, as disclosed, for example, in U.S. Pat. Nos. 7,033,714; 6,933,089; and 7,018,756, the disclosures of which are incorporated herein by reference in their entireties.

In one exemplary embodiment, charge transport layer 20 comprises an average of about 10 to about 60 weight percent N,N'-diphenyl-N,N'-bis(3-methylphenyl)-1,1'-biphenyl-4,4'-diamine, or from about 30 to about 50 weight percent N,N-diphenyl-N,N'-bis(3-methylphenyl)-1,1'-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. Pat. No. 7,018,756 incorporated by reference.

In one specific embodiment, the charge transport layer 20 is a solid solution including a charge transport component, such as N,N'-diphenyl-N,N'-bis(3-methylphenyl)-1,1'-biphenyl-4,4'-diamine, molecularly dissolved in a polycarbonate binder, the binder being either a bisphenol A polycarbonate of poly(4,4'-isopropylidene diphenyl carbonate) or a bisphenol Z polycarbonate of poly(4,4'-diphenyl-1,1'-cyclohexane carbonate). The bisphenol A polycarbonate used for typical charge transport layer formulation is FPC 0170, having a molecular weight of about 120,000 and commercially available from Mitsubishi Chemicals Corp. The molecular structure of bisphenol A polycarbonate, poly(4,4'-isopropylidene diphenyl carbonate), is given in Formula (A) below:

Formula (A)

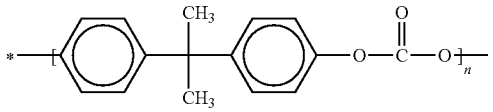

wherein n indicates the degree of polymerization. In the alternative, poly(4,4'-diphenyl-1,1'-cyclohexane carbonate) may also be used to for the anticurl back coating in place of MAKROLON. The molecular structure of poly(4,4'-diphenyl-1,1'-cyclohexane carbonate), having a weight average molecular weight of about between about 20,000 and about 200,000, is given in Formula (B) below:

Formula (B)

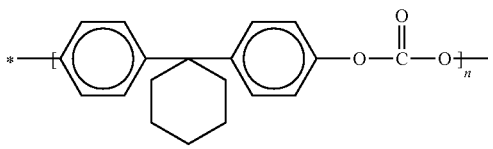

wherein n indicates the degree of polymerization.

The charge transport layer 20 may have a Young's Modulus in the range of from about $2.5\times10^{-5}$ psi ($1.7\times10^{-4}$ Kg/cm2) to about $4.5\times10^{-5}$ psi ($3.2\times10^{-4}$ Kg/cm2) and a thermal contraction coefficient of between about $6\times10^{-5}$° C. and about $8\times10^{-5}$° C.

Since the charge transport layer 20 can have a substantially greater thermal contraction coefficient constant compared to that of the support substrate 10, the prepared flexible electrophotographic imaging member will typically exhibit spontaneous upward curling, into a 1½ inch roll if unrestrained, due to the result of larger dimensional contraction in the charge transport layer 20 than the support substrate 10, as the imaging member cools from the glass transition temperature of the charge transport layer down to room ambient temperature of 25° C. after the heating/drying processes of the applied wet charge transport layer coating. Therefore, internal tensile pulling strain is build-in in the charge transport layer and can be expressed in equation (1) below:

$$\in=(\alpha_{CTL}-\alpha_{sub})(Tg_{CTL}-25^\circ\text{ C.}) \quad (1)$$

wherein $\in$ is the internal strain build-in in the charge transport layer, $\alpha_{CTL}$ and $\alpha_{sub}$ are coefficient of thermal contraction of charge transport layer and substrate respectively, and $Tg_{CTL}$ is the glass transition temperature of the charge transport layer. Therefore, equation (1), had indicated that to suppress or control the imaging member upward curling, decreasing the $Tg_{CTL}$ of the charge transport layer is indeed the key to minimize the charge transport layer strain and impact the imaging member flatness.

An anti-curl back coating 1 can be applied to the back side of the support substrate 10 (which is the side opposite the side bearing the electrically active coating layers) in order to render the prepared imaging member with desired flatness.

The Anticurl Back Coating

Since the charge transport layer 20 is applied by solution coating process, the applied wet film is dried at elevated temperature and then subsequently cooled down to room ambient. The resulting imaging member web if, at this point, not restrained, will spontaneously curl upwardly into a 1½ inch tube due to greater dimensional contraction and shrinkage of the Charge transport layer than that of the substrate support layer 10. An anti-curl back coating 1, as the conventional imaging member shown in FIG. 1, is then applied to the back side of the support substrate 10 (which is the side opposite the side bearing the electrically active coating layers) in order to render the prepared imaging member with desired flatness.

Generally, the anticurl back coating 1 comprises a thermoplastic polymer and an adhesion promoter. The thermoplastic polymer, in some embodiments being the same as the polymer binder used in the charge transport layer, is typically a bisphenol A polycarbonate, which along with the addition of an adhesion promoter of polyester are both dissolved in a solvent to form an anticurl back coating solution. The coated anticurl back coating 1 must adhere well to the support substrate 10 to prevent premature layer delamination during imaging member belt machine function in the field.

In a conventional anticurl back coating, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the anticurl back coating The adhesion promoter may be any known in the art, such as for example, VITEL PE2200 which is available from Bostik, Inc. (Middleton, Mass.). The anticurl back coating has a thickness that is adequate to counteract the imaging member upward curling and provide flatness; so, it is of from about 5 micrometers to about 50 micrometers or between about 10 micrometers and about 20 micrometers. A typical, conventional anticurl back coating formulation is a 92:8 ratio of polycarbonate to adhesive.

Figure 2:
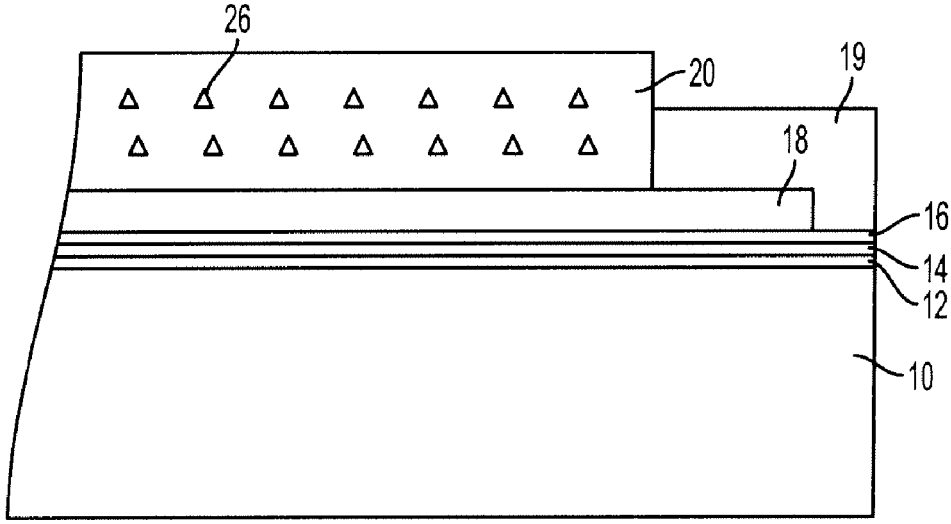
FIG. 2 is a cross-sectional view of a structurally simplified flexible multilayered electrophotographic imaging member having a single charge transport layer according to the present embodiments.

FIG. 2 discloses a curl free flexible imaging member prepared according to the material formulation and methodology of the present disclosure to have no anticurl back coating. In the embodiments, the substrate 10, conductive ground plane 12, hole blocking layer, 14, adhesive interface layer 16, charge generating layer 18, of the disclosed imaging member are prepared to include the same materials, compositions, thicknesses, and follow the identical procedures as those described in the conventional imaging member of FIG. 1, but with the exception that the charge transport layer 20 is reformulated to include an alkyl dibasic ester liquid plasticizer 26 selected from that of Formula (I) for incorporation into the charge transport layer 20, to effect its internal strain reduction and render the resulting imaging member with desirable flatness without the need of the anticurl back coating. The alkyl dibasic ester liquid chosen for charge transport layer plasticizing use has a general molecular structure shown in Formula (I):

$$R_1OOC(CH_2)_nCOOR_2 \quad \text{Formula (I)}$$

wherein n is an integer from 1 to 10; $R_1$ and $R_2$, $R_1$ and $R_2$ are the same or different and are an alky having from about 1 to about 4 carbons, such as $CH_3$, $CH_3CH_2$, $CH_3CH_2CH_2$, $CH_3CH_2CH_2CH_2$.

In essence, the presence of the plasticizer liquid in the layer material matrix, the Tg of the plasticized charge transport layer is therefore substantially depressed, such that the magnitude of (Tg−25° C.) becomes a small value to decrease charge transport layer internal strain, according to equation (1), and effect imaging member curling suppression. The reformulated charge transport layer 20 comprises an average of about 30% to about 70% weight of a diamine charge transporting compound such as mTBD (N,N'-diphenyl-N,N'-bis[3-methylphenyl]-[1,1'-biphenyl]-4,4'-diamine), about 70% to about 30% weight of polymer binder bisphenol A polycarbonate poly(4,4'-isopropylidene diphenyl carbonate) based on the combination weight of charge transport compound and polymer binder, and the addition of a plasticizing dially phthalate liquid. The content of this plasticizing liquid is in a range of from about 3 to about 30 weight percent or from about 6 to about 15 weight percent with respect to the summation weight of N,N'-diphenyl-N,N'-bis(3-methylphenyl)-1,1-biphenyl-4,4'-diamine (m-TBD) and the polycarbonate.

In the specific embodiment of FIG. 2, the substrate 10, conductive ground plane 12, hole blocking layer, 14, adhesive interface layer 16, charge generating layer 18, ground strip 19, and the charge transport layer 20 of the disclosed curl free flexible imaging member without anticurl back coating are prepared to include the same materials, compositions, thicknesses, and follow the identical procedures as have been described, but the plasticizer 26 incorporation in the charge transport layer (comprising charge transport compound m-TBD and polycarbonate binder) is dimethyl adipate liquid specifically derived from the dibasic alkyl ester of Formula (I). The molecular structure of dimethyl adipate liquid is shown in Formula (II) below:

$$CH_3OOC(CH_2)_4COOCH_3 \qquad \text{Formula (II)}$$

In another specific embodiment of FIG. 2, a substantially curl free flexible imaging member without anticurl back coating may also be prepared such that the plasticizer 26 incorporation in the charge transport layer 20 is dimethyl glutarate liquid specifically derived from the dibasic alkyl ester of Formula (I). The liquid dimethyl glutarate plasticizer having a molecular structure is shown in Formula (III):

$$CH_3OOC(CH_2)_3COOCH_3 \qquad \text{Formula (III)}$$

In another specific embodiment of FIG. 2, a substantially curl free flexible imaging member without anticurl back coating layer may further likewise be prepared as described above, but the plasticizer 26 incorporation in the charge transport layer 20 is a specific liquid of dimethyl succinate derived from Formula (I). The liquid dimethyl succinate plasticizer having a molecular structure is shown in Formula (IV):

$$CH_3OOC(CH_2)_2COOCH_3 \qquad \text{Formula (IV)}$$

Referring to FIG. 2, a substantially curl free flexible imaging member consisting of substrate 10, conductive ground plane 12, hole blocking layer, 14, adhesive interface layer 16, charge generating layer 18, ground strip 19, and without anticurl back coating layer may be prepared to have the very exact same materials, compositions, thicknesses, and follow the identical procedures as those described in the above disclosures, but with the exception that the charge transport layer 20 is again reformulated such that single plasticizer 26 incorporation in the charge transport layer is replaced with a binary mixture of two liquid plasticizers selected to be dimethyl adipate $CH_3OOC(CH_2)_4COOCH_3$ and dimethyl glutarate $CH_3OOC(CH_2)_3COOCH_3$. The weight ratio of dimethyl adipate to dimethyl glutarate is from about 10:90 to about 90:10.

In an alternative embodiment of FIG. 2, a substantially curl free flexible imaging member without anticurl back coating layer of present disclosure may also be alternatively prepared such that the binary mixture of plasticizers incorporated in the charge transport layer 20 consists of dimethyl adipate $CH_3OOC(CH_2)_4COOCH_3$ and dimethyl succinate $CH_3OOC(CH_2)_2COOCH_3$. The weight ratio of dimethyl adipate to dimethyl succinate is from about 10:90 to about 90:10.

In another alternative embodiment of FIG. 2, a substantially curl free flexible imaging member without anticurl back coating layer may also be prepared such that the binary mixture of plasticizers incorporated in the charge transport layer 20 consists of dimethyl glutarate $CH_3OOC(CH_2)_3COOCH_3$ and dimethyl succinate $CH_3OOC(CH_2)_2COOCH_3$. The weight ratio of dimethyl glutarate to dimethyl succinate is from about 10:90 to about 90:10.

In the exemplary extended embodiments of FIG. 2, the substantially curl free flexible imaging members consisting of substrate 10, conductive ground plane 12, hole blocking layer, 14, adhesive interface layer 16, charge generating layer 18, ground strip 19, and without anticurl back coating layer are to be prepared to include the same materials, compositions, thicknesses, and follow the identical procedures as those described in the above disclosures, but with the exception that reformulation of charge transport layer 20 is further extended to include mixture of three plasticizer components incorporation in the charge transport layer. The three plasticizers used for mixture preparation are selected from the three di-methyl dibasic esters of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$. Since each of these three dimethyl dibasic esters is by itself a viable plasticizer for charge transport layer incorporation, the three component plasticizers mixture can be prepared to have any desirable combination ratios. In one specific embodiment, the mixture weight ratio of dimethyl adipate/dimethyl glutarate/dimethyl succinate incorporated into the charge transport layer 20 of the curl free flexible imaging member is 19.2/58.4/22.4.

Figure 3:
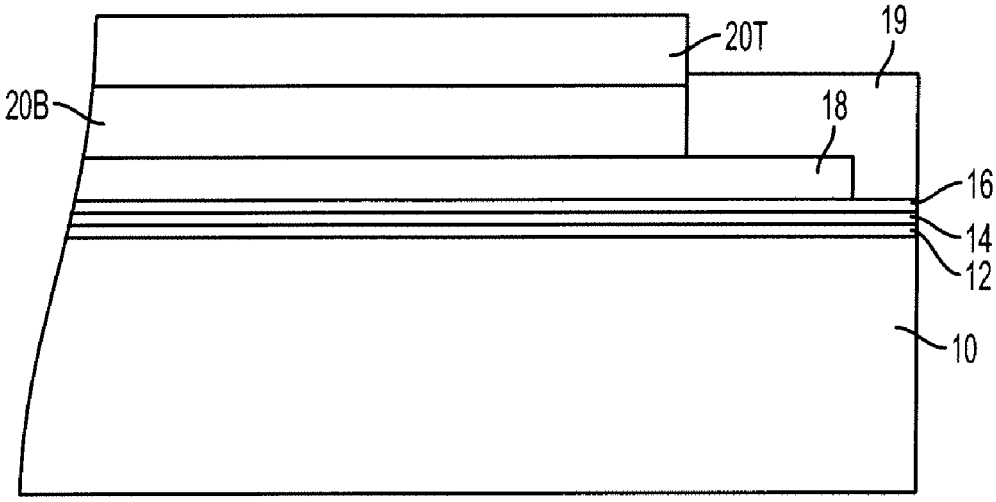
FIG. 3 is a cross-sectional view of a structurally simplified flexible multilayered electrophotographic imaging member having dual charge transport layers according to the present embodiments.

In the further extended embodiments of curl free flexible imaging member disclosure, shown in FIG. 3, the charge transport layer 20 of FIG. 2 is redesigned to comprise a plasticized dual layers using di-methyl dibasic ester: a bottom (first) layer 20B and a top (second) layer 20T. Both of these layers comprise about the same thickness and about the same amount of a di-methyl basic liquid plasticizer selected from dimethyl adipate $CH_3OOC(CH_2)_4COOCH_3$, or dimethyl glutarate $CH_3OOC(CH_2)_3COOCH_3$, or dimethyl succinate $CH_3OOC(CH_2)_2COOCH_3$. In modified embodiments, the dual charge transport layers are both plasticized with binary mixture of plasticizers consisting of dimethyl adipate $CH_3OOC(CH_2)_4COOCH_3$ and dimethyl succinate $CH_3OOC(CH_2)_2COOCH_3$. The weight ratio of dimethyl adipate to dimethyl glutarate is from about 10:90 to about 90:10. And alternatively, the dual layers may both be plasticized with binary mixture of plasticizers comprising dimethyl adipate $CH_3OOC(CH_2)_4COOCH_3$ and dimethyl succinate $CH_3OOC(CH_2)_2COOCH_3$. The weight ratio of dimethyl adipate to dimethyl succinate is from about 10:90 to about 90:10.

According to the modification of curl free flexible imaging member embodiments of this disclosure, the dual charge transport layers in FIG. 3 are to be plasticized with a triple mixture of plasticizers comprising dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$. Since each of these three dimethyl dibasic esters is itself a viable plasticizer for charge transport layer incorporation, the three component plasticizers mixture can be prepared to have any desirable combination ratios. In one specific embodiment, the triple mixture plasticizers weight ratio of dimethyl adipate/dimethyl glutarate/dimethyl succinate incorporated into each of the dual charge transport layers of the curl free flexible imaging member is 19.2/58.4/22.4.

Figure 4:
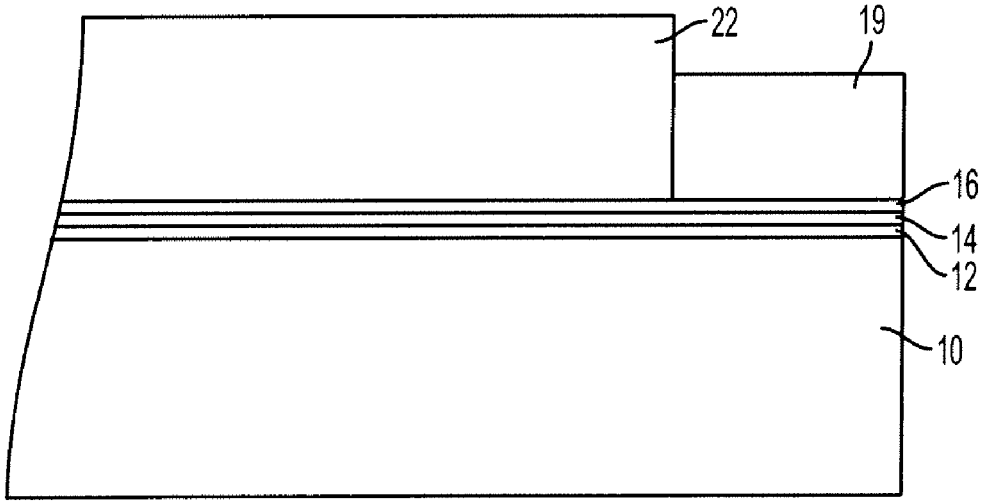
FIG. 4 is a cross-sectional view of a structurally simplified flexible multilayered electrophotographic imaging member having a single charge generating/transporting layer according to the present embodiments.

As an alternative to the two discretely separated layers of being a charge transport 20 and a charge generation layers 18 as those described in FIG. 1, a structurally simplified imaging member, having all other layers being formed in the same manners as described in preceding figures, may be created to contain a single imaging layer 22 having both charge generating and charge transporting capabilities and also being plasticized with the use of the present disclosed plasticizers to eliminate the need of an anticurl back coating according to the illustration shown in FIG. 4. The single imaging layer 22 may comprise a single electrophotographically active layer capable of retaining an electrostatic charge in the dark during electrostatic charging, imagewise exposure and image development, as disclosed, for example, in U.S. Pat. No. 6,756,169. The single imaging layer 22 may be formed to include charge transport molecules in a binder, the same to those of the charge transport layer 20 previously described, and may also optionally include a photogenerating/photoconductive material similar to those of the layer 18 described above. In exemplary embodiments, the single imaging layer 22 of the curl free flexible imaging member of the present disclosure, shown in FIG. 4, is plasticized to incorporate: (1) an alkyl dibasic ester selected from one of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$, (2) a binary mixture of dimethyl adipate $CH_3OOC(CH_2)_4COOCH_3$ and dimethyl succinate $CH_3OOC(CH_2)_2COOCH_3$ or dimethyl glutarate $CH_3OOC(CH_2)_3COOCH_3$ and dimethyl succinate $CH_3OOC(CH_2)_2COOCH_3$; or (3) a triple mixture of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$.

In all the above disclosed embodiments, the content of this plasticizing liquid (being a single component, or mixture of two components, or three components) employed, to plasticized the charge transport layer(s) of curl free flexible imaging members, is in a range of from about 3 to about 30 weight percent or from about 6 to about 15 weight percent with respect to the summation weight of N,N'-diphenyl-N,N'-bis(3-methylphenyl)-1,1-biphenyl-4,4'-diamine (m-TBD) and the polycarbonate. It is important to emphasize that the selection of a specific alkyl dibasic ester liquid or a mixture of which in different combinations for imaging member charge transport layer plasticizing application has to meet the conditions that: (a) being a high boiler liquid with boiling point exceeding 300° C. to ensure permanent presence in the charge transport layer for effecting plasticizing outcome and (b) it is a liquid totally miscible/compatible with both the charge transporting compound and the polymer binder such that its incorporation into the charge transport layer material matrix should cause no deleterious photoelectrical function of the resulting imaging member.

The flexible imaging members of present disclosure, prepared to contain a plasticized charge transport layer but no application of an anticurl backing layer, should have preserved the photoelectrical integrity with respect to each control imaging member. That means having charge acceptance ($V_0$) in a range of from about 750 to about 850 volts; sensitivity (S) sensitivity from about 250 to about 450 volts/ergs/cm$^2$; residual potential ($V_r$) less than about 100 volts; an a depletion potential (Vdepl) of between about 200 and about 3000 volts.

For typical conventional ionographic imaging members used in an electrographic system, an electrically insulating dielectric imaging layer is applied to the electrically conductive surface. The substrate also contains an anticurl back coating on the side opposite from the side bearing the electrically active layer to maintain imaging member flatness. In the present disclosure embodiments, ionographic imaging members may however be prepared without the need of an anticurl back coating, through plasticizing the dielectric imaging layer with the use of di-methyl dibasic ester(s) incorporation according to the same manners and descriptions demonstrated in the curl-free electrophotographic imaging members preparation above.

To further improved the disclosed imaging member design's mechanical performance, the plasticized top charge transport layer or single imaging layer, may also include the additive of inorganic or organic fillers to impart greater wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement.

The flexible multilayered electrophotographic imaging member fabricated in accordance with the embodiments of present disclosure, described in all the above preceding, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared flexible imaging belt thus may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limiting working examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Control Example

A conventional prior art flexible electrophotographic imaging member web, as shown in FIG. 1, was prepared by providing a 0.02 micrometer thick titanium layer 12 coated substrate of a biaxially oriented polyethylene naphthalate substrate 10 (PEN, available as KADALEX from DuPont Teijin Films.) having a thickness of 4.2 mils. The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer 14 had an average dry thickness of 0.04 micrometer as measured with an ellipsometer.

An adhesive interface layer 16 was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer 16 had a dry thickness of about 0.02 micrometer.

The adhesive interface layer was thereafter coated over with a charge generating layer 18. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-Z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer 18 having a thickness of 0.4 micrometers.

This coated web was simultaneously coated over with a charge transport layer 20 and a ground strip layer 19 by co-extrusion of the coating materials. The charge transport layer was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals Corp.) and a charge transport compound of N,N'-diphenyl-N,N'-bis(3-methylphenyl)-1,1-biphenyl-4,4'-diamine.

The resulting mixture was dissolved to give 15 percent by weight solid in methylene chloride. This solution was applied on the charge generating layer 18 by extrusion process to form a coating which after drying in a forced air oven gave a 29 micrometers thick dry charge transport layer comprising 50:50 weight ratio of diamine transport charge transport compound to FPC0170 bisphenol A polycarbonate binder. The imaging member web, at this point if unrestrained, would curl upwardly into a 1¾-inch tube.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (FPC 0170, available from Mitsubishi Chemical Corp.) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (ACHESON Graphite dispersion RW22790, available from Acheson Colloids Company (Port Huron, Mich.)) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then transported at 60 feet per minute web speed and passed through 125° C. production coater forced air oven to dry the co-extrusion coated ground strip 16 and charge transport layer 20 simultaneously to give respective 19 micrometers and 29 micrometers in dried thicknesses. Since the charge transport layer, having a glass transition temperature (Tg) of 85° C. and a coefficient of thermal contraction of about $6.6\times10^{-5}$/° C., it had about 3.7 times greater dimensional contraction than that of the PEN substrate having lesser a thermal contraction of about $1.9\times10^{-5}$/° C. Therefore, according to equation (1), a 2.75% internal strain was built-up in the charge transport layer to result in imaging member upward curling. The resulting imaging member web had a 29 micrometer-thick single layered charge transport layer, according to the conventional art shown in FIG. 1, but without application of an anticurl back coating was seen, if unrestrained as it cooled down to room ambient of 25° C., to spontaneously curl upwardly into a 1¾ inch roll. The prepared imaging member web was to be used to serve as a control.

Disclosure Example I

A curl free flexible electrophotographic imaging member web with no anticurl back coating, as shown in FIG. 2, was prepared with the exact same material compositions as the Control Example, using same 4.2 mil thick KADALEX substrate support, and following identical procedures as those described in the Control Example, but with the exception that the single charge transport layer 20 of the imaging member web was plasticized through the incorporation of 5 weight percent of a triple mixture of dimethyl dibasic esters consisting of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$. The composition of the triple mixture plasticizers had a weight ratio of dimethyl adipate/dimethyl glutarate/dimethyl succinate incorporation into the charge transport layer was 19.2/58.4/22.4 to give the resulting flexible imaging member a nearly flat configuration.

Disclosure Example II

A second curl free flexible electrophotographic imaging member web with no back coating was prepared with the exact same material compositions, same plasticizers mixture, using same 4.2 mil thick KADALEX substrate support, and following identical procedures as those described in the Disclosure Example I, but with the exception that the plasticized single charge transport layer 20 of the imaging member web had 8 weight percent incorporation of the very same triple mixture of dimethyl dibasic esters consisting of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$ to render the resulting flexible imaging member flatness.

Disclosure Example III

A third curl free flexible electrophotographic imaging member web with no back coating was prepared with the exact same material compositions, same plasticizers mixture, using same 4.2 mil thick KADALEX substrate support, and following identical procedures as those described in the Disclosure Example I, but with the exception that the plasticized single charge transport layer 20 of the imaging member web had 11 weight percent incorporation of the very same triple mixture of dimethyl dibasic esters consisting of dimethyl adipate $CH_3OOC(CH_2)_4COOCH_3$, dimethyl glutarate $CH_3OOC(CH_2)_3COOCH_3$, and dimethyl succinate $CH_3OOC(CH_2)_2COOCH_3$ to effect the resulting flexible imaging member with desired flatness.

Curl, Tg, and Photoelectrical Properties Determination

The prepared imaging member webs, having plasticized charge transport layer (CTL) by incorporation triple di-methyl dibasic esters mixture into its material matrix of the Disclosure Examples I, II, and III were subsequently evaluated for the respective degree of upward imaging member curling, CTL glass transition temperature (Tg), and photoelectrical properties integrity for comparison against those values of the imaging member of the Control Example counterpart.

Curl and Tg Assessment:

The assessment for curl-up exhibition in the plasticized single CTL imaging member webs was conducted by measurement of each respective diameter of curvature and then compared against to that seen for the imaging member of Control Example prior to its application of anticurl back coating. These imaging members were also determined for their CTL glass transition temperature (Tg), using Differential Scanning calorimetry (DSC) method. The results thus obtained for the three Disclosure imaging member webs, comprising a triple plasticizers (DBE) mixture CTL, and that for the control counterpart are tabulated in Table 1 below:

TABLE 1

| Plasticized CTL | | |
|---|---|---|
| IMAGING MEMBER CTL | DIAMETER OF CURVATURE | Tg (° C.) |
| Control Example | 1¾ inches | 87 |
| Plus 5% Triple DBE Mixture | Nearly Flat | 74 |
| Plus 8% Triple DBE Mixture | Flat | 67 |
| Plus 11% Triple DBE Mixture | Flat | 58 |

The data given in the above table show that the single layered CTL plasticized with a triple plasticizers (DBE) mixture according to Disclosure Examples I, II, and III was able to sufficiently suppress the imaging member webs from upward curling. At 8 weight percent plasticizers loading level the imaging members curling was effectively eliminated.

Even though plasticizing the CTL was found effective to effect imaging member curl control, nevertheless at loading level of 10 weight percent, it did cause CTL Tg depression. Since the typically operation temperature of all xerographic imaging machines is less than 40° C., so the CTL Tg depression to 58° C., at 11 weight percent plasticizers mixture loading level, w4s still way above the imaging member belt machine functioning temperature in the field.

Photoelectrical Properties Determination:

The three prepared imaging member webs of Disclosure Examples I, II, and III, each comprising a triple plasticizers mixture (DBE) plasticizing CTL for curl control, were then analyzed for complete photo-electrical properties against the conventional imaging member counterpart of Control Example using the lab. 4000 scanner test to assure proper function. The results thus obtained, shown in below Table 2 below, had demonstrated that incorporation of the plasticizer liquid(s) according to the description of the present disclosure, at the three experimental loading levels into the CTL, had not been found to substantially impact the crucially important photoelectrical properties of the resulting curl free imaging member webs compared to those properties of the control imaging member web counterpart. These results had therefore assured proper imaging member belt functional integrity under a normal machine operation condition in the field.

TABLE 2

| Photoelectrical Properties | | | | | | | |
|---|---|---|---|---|---|---|---|
| Imaging Member ID | DBE, % | V0 | S | Vc | Vr | Vdepl | A |
| Control Example | 0 | 799 | 355 | 155 | 28.6 | 73.0 | −183.0 |
| Disclosure I | 5 | 799 | 356 | 164 | 31.3 | 91.7 | −167.1 |
| Disclosure II | 8 | 798 | 315 | 18 | 39.2 | 100.0 | −237.1 |
| Disclosure III | 11 | 799 | 368 | 170 | 33.6 | 101.5 | −164.7 |
| After 10K cycling | | | | | | | |
| Control Example | 0 | 799 | 354 | 195 | 46.9 | 118.4 | −221.5 |
| Disclosure I | 5 | 799 | 342 | 198 | 57.7 | 139.4 | −201.6 |
| Disclosure II | 8 | 798 | 298 | 213 | 76.5 | 156.1 | −171.9 |
| Disclosure III | 11 | 799 | 353 | 207 | 65.9 | 152.4 | −234.7 |

Additionally, plasticizing the CTL, in the loading levels described for imaging members of all the above Disclosure Examples, was all found to have good layer adhesion value greater than that of the adhesion specification; this would therefore ensure that the CTL layer's bonding strength and integrity without the possibility of delamination during imaging member belt dynamic fatigue machine function in the field.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

The invention claimed is:

1. A flexible imaging member comprising:

a flexible substrate;

a charge generating layer disposed on the substrate; and at least one charge transport layer disposed on the charge generating layer, wherein the charge transport layer comprises a charge transport component molecularly dispersed in a polycarbonate binder and a mixture of plasticizers, wherein the mixture of plasticizers comprises two or more plasticizers selected from the group consisting of dimethyl adipate, dimethyl glutarate, and dimethyl succinate, and further wherein the flexible imaging member does not include an anticurl back coating layer.

2. The flexible imaging member of claim 1, wherein the charge transport component in the charge transport layer is N,N'-diphenyl-N,N'-bis(3-methylphenyl)-1,1-biphenyl-4,4'-diamine.

3. The flexible imaging member of claim 1, wherein the polycarbonate binder in the charge transport layer is a bisphenol A polycarbonate of poly(4,4'-isopropylidene diphenyl carbonate) or a bisphenol Z polycarbonate of poly(4,4'-diphenyl-1,1'-cyclohexane carbonate).

4. The flexible imaging member of claim 1, wherein the mixture of plasticizers is a binary plasticizer mixture comprising $CH_3OOC(CH_2)_4COOCH_3$ and $CH_3OOC(CH_2)_3COOCH_3$ in a weight ratio of from about 10:90 to about 90:10.

5. The flexible imaging member of claim 1, wherein the mixture of plasticizers is a binary plasticizer mixture comprising $CH_3OOC(CH_2)_4COOCH_3$ and $CH_3OOC(CH_2)_2COOCH_3$ in a weight ratio of from about 10:90 to about 90:10.

6. The flexible imaging member of claim 1, wherein the mixture of plasticizers is a binary plasticizer mixture comprising $CH_3OOC(CH_2)_3COOCH_3$ and $CH_3OOC(CH_2)_2COOCH_3$ in a weight ratio of from about 10:90 to about 90:10.

7. A flexible imaging member comprising:

a flexible substrate;

a charge generating layer disposed on the substrate; and multiple charge transport layers disposed on the charge generating layer, wherein the multiple charge transport layers each comprise a charge transport component molecularly dispersed in a polycarbonate binder and a mixture of plasticizers, wherein the mixture of plasticizers comprises two or more plasticizers selected from the group consisting of dimethyl adipate, dimethyl glutarate, and dimethyl succinate, and further wherein the flexible imaging member does not include an anticurl back coating layer.

8. The flexible imaging member of claim 7, wherein each charge transport layer comprises a mixture of plasticizers and the amount of plasticizers in each charge transport layer is the same.

9. The flexible imaging member of claim 8, wherein the mixture of plasticizers comprises dimethyl adipate, dimethyl glutarate, and dimethyl succinate.

10. The flexible imaging member of claim 9, wherein a weight ratio of the mixture of plasticizers in each charge transport layer is the same.

11. The flexible imaging member of claim 9, wherein a weight ratio of the mixture of plasticizers in each charge transport layer is different.

12. The flexible imaging member of claim 7, wherein the multiple charge transport layers are comprised of dual layers or triple layers.

13. A flexible imaging member comprising:

a flexible substrate;

a single imaging layer disposed on the substrate, wherein the single imaging layer has both charge generating and charge transporting capabilities and comprises a charge transport component molecularly dispersed in a polycarbonate binder and a mixture of plasticizers, wherein the mixture of plasticizers comprises two or more plasticizers selected from the group consisting of dimethyl adipate, dimethyl glutarate, and dimethyl succinate, and further wherein the flexible imaging member does not include an anticurl back coating layer.

14. The flexible imaging member of claim 13, wherein the mixture of plasticizers in the single imaging layer comprises dimethyl adipate, dimethyl glutarate, and dimethyl succinate.

15. A flexible imaging member comprising:

a flexible substrate;

a charge generating layer disposed on the substrate; and at least one charge transport layer disposed on the charge generating layer, wherein the charge transport layer comprises a charge transport component molecularly dispersed in a polycarbonate binder and a triple plasticizer mixture comprising dimethyl adipate, dimethyl glutarate, and dimethyl succinate in a weight ratio of 19.2/58.4/22.4.

* * * * *